United States Patent [19]

Armstrong

[11] 4,333,530

[45] Jun. 8, 1982

[54] METHOD AND APPARATUS FOR CEMENTING A CASING

[76] Inventor: Ernest E. Armstrong, 3521 Seaboard, Midland, Tex. 79701

[21] Appl. No.: 967,791

[22] Filed: Dec. 8, 1978

Related U.S. Application Data

[63] Continuation-in-part of Ser. No. 714,589, Aug. 16, 1976, Pat. No. 4,105,074, and a continuation-in-part of Ser. No. 814,396, Jul. 11, 1977, abandoned.

[51] Int. Cl.[3] ..... E21B 33/16

[52] U.S. Cl. ..... 166/289; 166/291; 166/331; 166/332

[58] Field of Search ..... 166/289, 291, 334, 331, 166/332, 240, 55, 55.1, 297, 298, 264, 250, 314

[56] References Cited

U.S. PATENT DOCUMENTS

| | | | |
|---|---|---|---|
| 1,639,004 | 8/1927 | Riley et al. | 166/334 |
| 2,004,606 | 6/1935 | Halliburton | 166/289 |
| 2,168,735 | 8/1939 | Gilstrap | 166/289 |
| 2,374,169 | 4/1945 | Boynton | 166/289 |
| 2,436,036 | 2/1948 | Defenbaugh | 166/55 |
| 2,495,642 | 1/1950 | Penick | 166/334 |
| 2,609,881 | 9/1952 | Warren | 166/297 |
| 2,860,853 | 11/1958 | Brigham | 166/289 |
| 3,064,731 | 11/1962 | Hall | 166/297 |
| 3,097,699 | 7/1963 | Orr | 166/289 |
| 3,216,452 | 11/1965 | Williams | 166/289 |
| 3,315,747 | 4/1967 | Farley et al. | 166/331 |
| 3,610,337 | 10/1971 | Lewis | 166/331 |
| 4,003,433 | 1/1977 | Goins | 166/298 |
| 4,144,936 | 3/1979 | Evans | 166/298 |

*Primary Examiner*—James A. Leppink

*Attorney, Agent, or Firm*—Gerald G. Crutsinger; John F. Booth; Monty L. Ross

[57] ABSTRACT

Method and apparatus for cementing a casing in a borehole in two distinct stages by connecting the tool of the invention in series relationship respective to the casing and running the entire tool string downhole into the borehole. The tool which connects the upper and lower casing strings together includes a coupling member actuated by relative movement between the upper and lower strings. The tool always captures the upper and lower casing strings to one another and when the tool is unlatched and the upper casing string lifted, a lateral flow passageway is opened which enables cement to be pumped downhole to the tool and laterally directly into the borehole annulus. The tool therefore enables cement to be pumped along an isolated flow path to the bottom of the borehole, and thereafter pumped down the upper casing string and laterally from the tool directly into a mid-portion of the borehole annulus causing the cement to flow uphole towards the surface of the ground, and thereafter the upper string is again moved respective to the lower string, thereby closing the lateral flow passageway, whereupon the tool becomes a permanent part of the casing string.

19 Claims, 9 Drawing Figures

METHOD AND APPARATUS FOR CEMENTING A CASING

RELATED PATENT APPLICATION

My co-pending patent application Serial No. 714,589 filed Aug. 16, 1976 now U.S. Pat. No. 4,105,074 entitled: "Cement Staging Tool"; and, my co-pending patent application Ser. No. 814,396 filed July 11, 1977, now abandoned, of which this patent application is a Continuation in Part.

BACKGROUND OF THE INVENTION

In carrying out various oil well completion and production operations, after a borehole has been formed several thousand feet down into the ground, a casing must be cemented into place in order to separate the various different fluid producing stratus of the earth from one another and also to prevent various different formation fluids from mixing with one another. After the casing has been cemented into place, the lower casing string is perforated adjacent a hydrocarbon producing formation so that the well can be produced. Where the pay zone is inadequate to sustain the cost of production, the well is plugged and abandoned thereby losing the valuable casing. Accordingly, it would be desirable to be able to retrieve part of the casing from the borehole, thereby enabling the casing to be subsequently used in another borehole and effecting a savings of thousands of dollars.

During the cementing operation, it is desirable that cement be pumped downhole through the entire casing string and back uphole through the borehole annulus, thereby assuring that the outer periphery of the casing is bonded along its entire length to the borehole wall. Accordingly, it is desirable that the cementing take place in two different stages thereby avoiding the difficulties involved with forcing cement several thousand feet down through the casing and several thousand feet back up the borehole annulus. It would further be desirable that staging be carried out by first pumping cement down the entire casing string and back up the borehole annulus toward a medial portion of the string, and thereafter the cement pumped only halfway down the casing and laterally into the annulus after which the cement is again forced back up the upper borehole annulus to the surface of the ground.

It would especially be desirable to be able to carry out the cementing operation without the necessity of drilling cement from the interior of the casing string.

SUMMARY OF THE INVENTION

This invention relates specifically to a method and apparatus for cementing casing in two stages. The method comprises connecting an upper and lower casing string together in a borehole and cementing the lower casing string and thereafter forming a lateral flow path at a location where the upper and lower casing strings are joined, with the lateral flow path extending directly into the borehole annulus so that cement can be pumped through the upper string, directly into the borehole annulus, and back uphole to the surface of the ground. The lateral flow path is closed by manipulating the upper string. Means are provided whereby the upper and lower strings are always connected together in a permanent manner, yet the upper string can be either rotated or reciprocated respective to the lower string.

The above method enables the lower string to be connected in place, the well tested, and a substantial portion of the string retrieved in the event insufficient pay is realized from the production zone. The method also provides a means for cementing casing in a manner which avoids subsequent drilling of the cement from the interior of the casing string. Moreover, scratches may be placed on the upper casing string and the upper string manipulated to condition the borehole wall for a superior cement bond.

The above method is attained by the provision of a cement staging tool series connected within a casing string thereby forming an upper and a lower casing string. The tool includes a mandrel and a barrel telescopingly captured together so that the mandrel can move a limited distant respective to the barrel, and can be rotated an unlimited number of revolutions respective thereto. A seat and seal assembly is formed between the mandrel and barrel so that when the mandrel is telescoped down, the seal engages the seat, thereby providing an isolated, unobstructed flow path which extends longitudinally through the central axis of the tool and hence through the entire casing string. When the seal assembly is lifted from the seat, a lateral flow path is formed directly into the borehole annulus through which cement can be pumped. A latch assembly enables the mandrel to be latched to the barrel with the seal assembly sealingly engaging the seat, thereby enabling the tool to become a permanent part of the casing string when the entire string is cemented into place.

Accordingly, a primary object of this invention is the provision of a method of cementing a casing within a borehole in two distinct stages.

Another object of this invention is to present a method of cementing a lower casing string into a borehole and thereafter retrieving most of the casing string from the borehole after testing the well for production.

A further object of this invention is to teach a method of flowing cement through a casing string so as to cement the lower casing string within the borehole and thereafter laterally flowing cement directly into another marginal length of the borehole annulus to complete the cementing job.

A still further object of the invention is the provision of a no-drill cement staging tool for series connecting an upper and lower casing string and which permits the casing string to be cemented within a wellbore in two different operations.

Another object of the invention is the provision of a cement staging tool having a lost motion coupling associated therewith which permits an upper casing string to be moved respective to the lower casing string while the upper and lower strings are always attached to one another, and wherein movement of the upper string respective to the lower string opens and closes a lateral flow path through the tool.

A still further object of the invention is the provision of a method of cementing casing into a borehole wherein there is no need for subsequently drilling cement from the interior of the casing.

Still another object of the invention is to provide a novel cement staging tool having a seat and seal assembly therein which is moved into engagement with one another by manipulating opposed ends of the tool, and with there being a latch means by which the seal is latched into engagement with the seat, and with there being a lateral flow passageway which is opened when the opposed ends of the tool are moved apart.

A further object of this invention is the provision of method and apparatus for conditioning the upper borehole wall by manipulation of the casing string from the surface to achieve an improved cement bond after the lower end of the casing string has been cemented into place.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
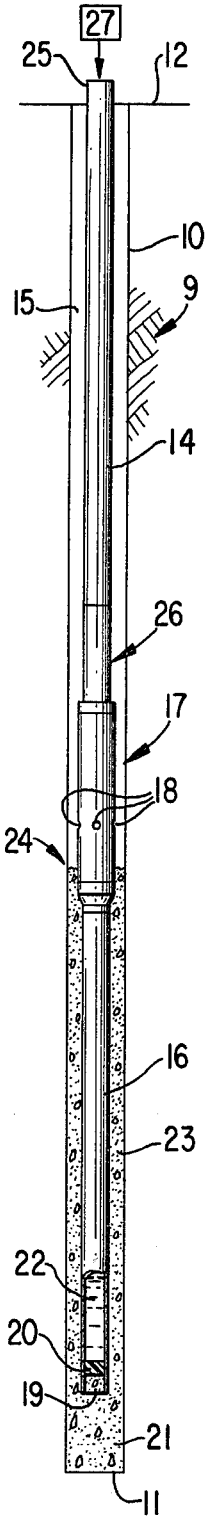
FIGS. 1–4 are diagrammatical illustrations of a cross-sectional view of a borehole formed into the earth with apparatus made in accordance with the present invention being associated therewith.
Figure 2:
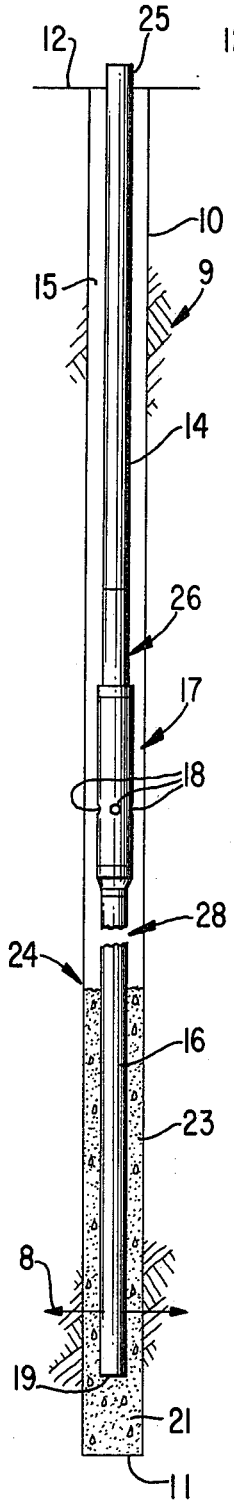
Figure 3:
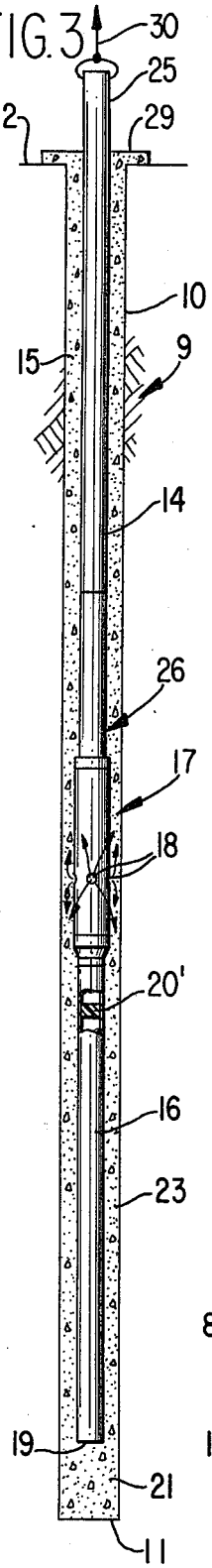
Figure 4:
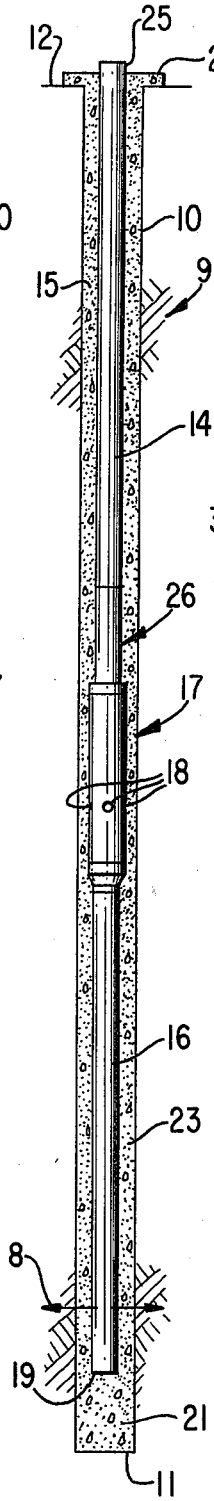

In FIGS. 1–4 of the drawings there is disclosed the method of the present invention. As seen in FIGS. 2 and 4, together with FIGS. 1 and 3, a hydrocarbon containing zone has been perforated at 8. An aquifer 9 lies uphole in the borehole 10. The borehole is formed through the earth and extends through the aquifer and the hydrocarbon containing zone. The bottom 11 of the borehole is sometimes located several thousand feet below the surface 12 of the ground. An upper casing string 14 is positioned within the borehole with there being an upper borehole annulus 15 formed therebetween. The upper casing string is separated from a lower casing string 16 by a coupling member in the form of a cement staging tool 17 made in accordance with the present invention. The tool includes lateral flow ports 18, the details of which will be better understood later on as this disclosure is more fully digested.

The lower end of the borehole has cement located therein, the cement having been pumped into the bottom of the borehole as indicated by the numeral 21. A combination swab and plug 20 separates the cement 19 from casing fluid 22. The cement has been forced up the borehole annulus at 23. As seen in FIG. 1, the cement terminates at 24 in proximity of the tool; or, as seen in FIG. 2, the cement can instead terminate well downhole of the tool 17.

The upper end 25 of the casing extends into proximity of the surface of the ground with the opposed end thereof being connected to the upper end 26 of the tool 17. A plurality of commercially available scratchers 114 are attached to the upper casing string in spaced relationship respective to one another.

As seen in FIG. 2, the casing has been parted at 28 at a location above the top 24 of the cement 23.

In FIG. 3 plug 20' has been placed below the tool and the lateral flow passageways 18 have been opened by manipulating the upper casing string so that cement flows directly from the tool 17 into the borehole annulus and uphole to the surface of the ground as seen at 29. Numeral 30 broadly indicates means for manipulating the upper casing string, as for example a workover rig or a pulling unit.

In FIG. 4 the upper string has been set down, thereby closing the lateral flow ports 18, and latching the upper and lower strings together. Cement extends from 21, uphole at 23 and 15, and to the surface of the ground as seen at 29. The tool 17 has effectively become a permanent part of the casing string.

Figure 5:
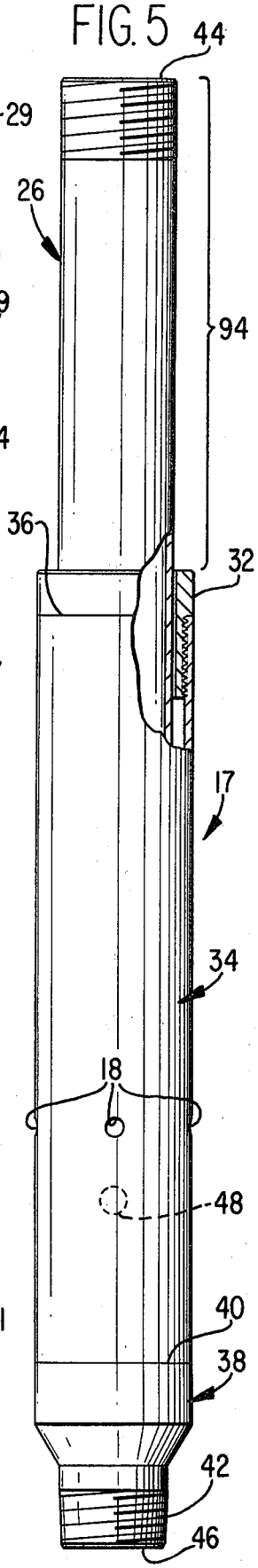
FIG. 5 is an enlarged, side elevational view of a tool made in accordance with the present invention, with some parts thereof being broken away therefrom, and some of the remaining parts being shown in cross-section.

FIGS. 5–9 disclose details of the cement staging tool 17. As seen in FIG. 5, together with other figures of the drawings, the before mentioned upper end 26 of the tool 17 is in the form of a hollow mandrel. The mandrel is telescopingly received by a tubular or hollow barrel 34. The hollow cylindrical barrel has a bushing 32 removably affixed at the upper end thereof which forms interface 36 between the bushing and the main body 34 of the barrel. A lower sub 38 is removably affixed to the lower end of the barrel and forms an interface 40 therebetween. The reduced lower end of the sub is threaded at 42 while the upper end of the mandrel is threaded at 44, thereby enabling the tool to be series connected within a casing string in a manner to divide the string into the before mentioned upper and lower casing strings of FIGS. 1–4.

Figure 6:
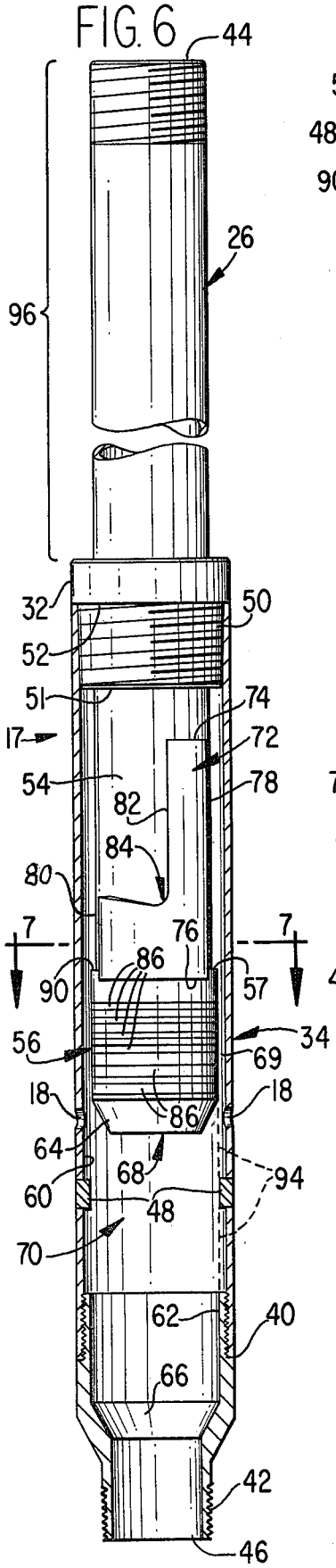
FIG. 6 is a part cross-sectional, side elevational view which illustrates the tool of FIG. 5 in one of its alternate configurations.

In FIG. 6, together with other figures of the drawings, a J-latch guide 48 is rigidly attached to opposed interior sidewalls of the barrel. Spaced from the guides is the threaded surface 50 of the bushing which terminates in a lower shoulder 51. Upper shoulder 52 of the bushing engages the upper end of the barrel to form the before mentioned interface 36. The distance between the latch and the shoulder 51 can be of any convenient length, depending upon the magnitude of stroke desired when the mandrel reciprocates respective to the barrel.

Marginal end 54 of the mandrel is captured within the interior of the barrel and is slidably received therewithin for a limited distance, as noted above, and as will be pointed out in greater detail later on.

The lower marginal end portion of the mandrel terminates in an enlarged seal assembly 56. The seal assembly is provided with a plurality of spaced seal elements 58 in the form of o-rings 86 or the like. The seal assembly is slightly spaced from the interior wall 60 of the barrel an amount equal to the thickness of the J-latch guide means 48. Accordingly, the seal means can slide past the guide means in close tolerance relationship therewith. The upper end of the seal terminates in a pair of shoulders 57 and 90.

The sub 38 has a receptacle 62 formed therewithin for sealingly engaging the plurality of o-rings of the seal means in close tolerance and sealed relationship therewith. Conical face 66 forms a seat against which a complementary conical face 64 of the seal means is abuttingly received. A hollow outlet end 68 of the seal means is in fluid communication with the central passageway formed axially through the mandrel, barrel, and sub. Annular chamber 69 is formed between the seal and the inside peripheral wall of the barrel. The lower marginal end of the mandrel therefore reciprocates within the lower chamber 70 of the barrel.

Member 72 includes a portion thereof which is in the form of a J and for this reason is called a "J latch assembly" in conjunction with member 48. The J extends outwardly away from the outside peripheral wall of the mandrel, into close tolerance relationship respective to the inside peripheral wall of the barrel as best seen illustrated in FIGS. 6, 7, and 8. The J includes a top edge 74 which abuttingly engages the circumferentially extending shoulder 51 of the guide or bushing 32. The bottom edge 76 of the J terminates slightly below shoulder 57 of the seal. An elongated longitudinally disposed side edge 78 of the J is spaced from opposed sides 80, 82 with the opposed sides 80, 82 being separated by cut-out 84. The guide 48 is therefore removably captured within the inclined portion of the J which forms the aforesaid cut-out.

Figure 7:
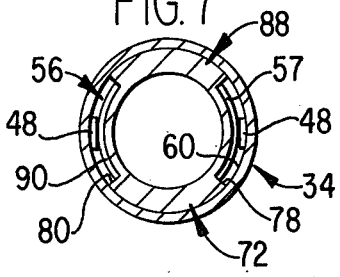
FIG. 7 is a cross-sectional view taken along line 7—7 of FIG. 6.

As best seen in FIG. 7, the opposed J 88 is identical to the J at 72 and is located 180° in spaced relation therefrom. Seal shoulder 90 is located 180° from seal shoulder 57.

Figure 8:
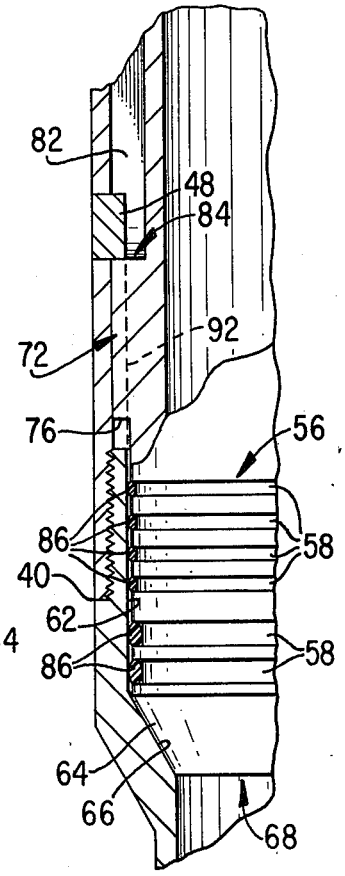
FIG. 8 is an enlarged, fragmented, part cross-sectional view which sets forth some of the details of the tool disclosed in the foregoing figures; and, FIG. 9 is an exploded perspective view of a tool made in accordance with the present invention.

Numeral 92 of FIG. 8 is a dot-dash line indicating that the face of guide 48 is aligned with the inside peripheral wall surface of sub receptacle 62, and accordingly, the bottom 76 of the J abuttingly engages the top edge portion of the receptacle.

The tool of the present invention is assembled by first screwing the guide 32 into the illustrated position seen in FIG. 5 after which end 44 of the mandrel is telescoped into the lower end at 40 of the barrel, thereby placing the barrel and mandrel into the configuration of FIG. 6. The sub 38 is next threadedly made up to the lower threaded end of the barrel, thereby completing the assembly of the tool into the configuration of FIG. 6. The mandrel can now be lowered to seat the seal assembly within the receptacle, with the conical faces 64 and 66 abuttingly engaging one another. The mandrel is turned to the right whereupon the guides 48 are received within the cutouts at 84. There must be sufficient lost motion between the faces 64, 66 to compensate for the guides traveling up the inclined face of the cut-out in order that the J latch assembly can properly function.

The tool is placed in the latched or closed configuration and made up into the casing string while going into the hole, with the tool preferably being placed approximately midway between the pay zone 8 and aquifer 9; or, alternatively, midway between the bottom 11 and ground surface 12 of the borehole depending upon the depth of the borehole and the distance the cement must flow uphole.

Next a measured amount of cement is pumped by means 27 down through the interior of the casing followed by the plug 20 and fresh water 22 as seen illustrated in FIG. 1. The plug 20 maybe soluble, such as a plug of soap, for example, or alternatively, can be made of plastic-like or resilient material. As the fresh water 22 and plug 20 forces the cement from the lower end of the casing string, the cement slurry is forced to flow uphole towards the tool 17. The flow of cement is terminated in proximity of the tool as indicated by the numeral 24 of FIGS. 1 and 2.

In some instances where the value of the pay zone is questionable, it is desirable to perforate and test the well prior to cementing the remainder of the casing within the borehole, for the reason that should the well prove to be a dry hole, the casing can be retrieved in the illustrated manner of FIG. 2. In order to retrieve the casing, a casing cutter is run downhole and detonated thereby severing the tool string below the tool whereupon the upper string and tool can be lifted from the hole thereby enabling the tool and a substantial length of the casing string to be salvaged in good working condition and subsequently recycled.

On the other hand, where the perforated zone 8 indicates good pay, the well completion is continued by turning and lifting the upper casing string in the illustrated manner of FIG. 3 and flowing cement down the casing string, through the tool 17, laterally out of the bypass ports 18, into and back up the upper casing annulus, and to the surface of the ground at 29.

During this time a second plug 20' can be pumped downhole by the cement in order to prevent the cement from flowing on down into the lower casing string. Where deemed desirable a third plug followed by fresh water can be utilized to clean the casing behind the last flow of the cement.

While running the casing into the borehole, the casing scratchers or scrapers 114 are affixed to each casing joint. After the lower casing string has been cemented into place and the tool has been unlatched, the upper casing string is manipulated from the surface at 30 by reciprocating while concurrently rotating the string, thereby causing the scratchers or scrapers to engage and remove any residue from the borehole wall. This improves the bond between the cement and the wall of the borehole.

To augment the method of the present invention, sugar, molasses, or the like can be admixed with the water in an amount of about ten pounds per barrel in order to prevent any residual cement adhering to the casing wall from setting. This expedient enhances subsequent removal of the residual cement from the inside peripheral sidewall of the casing.

After flowing sufficient cement into the casing annulus the upper string is lowered into the illustrated position of FIGS. 4 and 8, the upper string is rotated to latch the guide within the cut-out of the J, and therefore the tool becomes a permanent part of the casing string. The cement hardens and the Christmas tree is installed at the upper end of the casing along with other downhole equipment as may be required depending upon the peculiarities of the formation and the production techniques desired to be employed.

Figure 9:
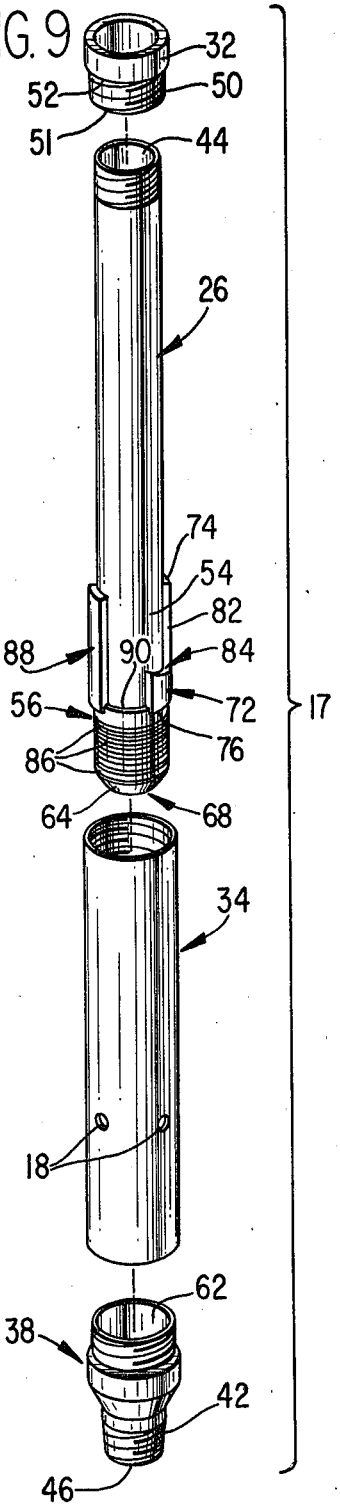

In FIGS. 5, 6, and 9, a number of radially spaced washup ports 118 are spaced from the larger lateral flow ports 18. The washup ports 118 preferably are located in close proximity to the seat 66 at a location uphole of the threads of the sub 38. The main lateral flow of cement occurs through ports 18, while ports 118 enable a small amount of water to flow therethrough as the valve member 56 is moved towards the seat member 66. This enables a small amount of water to provide a washing action for removing any residual cement from the seal and seat of the coupling member.

I claim:

1. Method of cementing a casing in a borehole comprising:

(1) connecting an upper casing string and a lower casing string together with a coupling member while running the casing string into the borehole;
(2) forming an isolated flow path which extends through the entire casing string to the bottom of the borehole;
(3) flowing cement along said isolated flow path and back up the borehole annulus to cement the lower casing string within the lower borehole;
(4) perforating the lower casing string after the first cementing stage of step (3), testing the well to determine the production rate thereof, shutting in the well, and thereafter continuing with step (5);
(5) moving the upper casing string respective to the lower casing string, using the relative movement effected between the upper and lower casing strings to form a lateral flow path which extends through the upper casing string and directly from the coupling member into the borehole annulus;
(6) flowing cement through the upper casing string, down to the lateral flow path and directly into the borehole annulus at a location above the lower casing string, and forcing cement to flow up the borehole annulus towards the surface of the ground;
(7) moving the upper casing string and using the relative movement effected between the upper and lower casing strings to close the lateral flow path and to form a sealed flow passageway through the coupling member; and,
(8) leaving the coupling member downhole as a permanent part of the casing string.

2. The method of claim 1 wherein steps (5) and (7) are carried out by making said member into a lost motion coupling and using reciprocal motion of the upper string to open or close the lateral flow path of the coupling member.

3. The method of claim 2 and further including the step of using a J latch to maintain the lost motion coupling latched into the closed configuration so that the lateral flow path can be opened only by turning the upper casing string and thereafter lifting the upper casing string.

4. The method of claim 1 and further including the step of placing a plug device behind the flowing cement of step (3) and using a fluid to force the plug and cement towards the bottom of the casing so that drilling of cement from the interior of the casing is avoided.

5. The method of claim 1 and further including the step of placing a plug device ahead of the flowing cement of step (6) to avoid the necessity of subsequently drilling cement from the interior of the casing.

6. A method of cementing a casing into a borehole which requires no subsequent drilling of cement therefrom comprising the steps of: connecting a coupling member in series relationship within a casing string as the casing is being made up and run into the borehole; closing a lateral flow path which extends from the interior of the casing, directly through the coupling member, and into the borehole annulus which can be opened by moving the upper string relative to the lower string; flowing cement along an isolated flow path which extends from the surface of the ground, down through the upper casing string, through the coupling member, through the lower casing string, and back up the borehole annulus into proximity of the coupling member, and controlling the flow such that the resulting cement extends from the bottom of the casing, up the borehole annulus, and terminates in proximity of the coupling member; perforating the casing at a location below said coupling member and testing the perforated zone to determine the production rate thereof; and severing the lower casing string below the coupling member and removing the casing string and coupling member located above the severed part of the lower casing string from the borehole.

7. The method of claim 6 and further including the step of placing a plug device behind the flowing cement and using a fluid to force the plug and cement towards the bottom of the casing so that drilling of cement from the interior of the casing is avoided.

8. The method of claim 6 and further including the step of making said coupling member into a lost motion coupling and using reciprocal motion of the upper string to open and close the lateral flow path of the coupling member.

9. The method of claim 8 and further including the step of using a J latch to maintain the lost motion coupling latched into the closed configuration so that the lateral flow path can be opened only by turning the upper casing string and thereafter lifting the upper casing string.

10. A method of cementing a casing into a borehole which requires no subsequent drilling of cement therefrom comprising the steps of:

connecting a coupling member in series relationship within a casing string as the casing is being made up and run into the borehole;

flowing cement along an isolated flow path which extends from the surface of the ground, down the upper casing string, through the coupling member, through the lower casing string, and back up the borehole annulus into proximity of the coupling member and controlling the flow such that the resulting cement extends from the bottom of the casing, up the borehole annulus, and terminates in proximity of the coupling member;

perforating the casing at a location below said coupling member and thereafter testing the perforated zone to determine the production rate thereof;

forming a lateral flow path which extends from the interior of the casing, directly through the coupling member, and into the borehole annulus by moving the upper string relative to the lower string when said test indicates a relatively high production rate, and thereafter;

flowing cement along an isolated flow path which extends from the surface of the ground, down through the upper casing string, through the coupling member, and back up the borehole annulus into proximity of the surface of the ground, such that cement fills the entire borehole annulus;

closing the lateral flow path by moving the upper string respective to the lower string and leaving the coupling member cemented into the wellbore as a permanent part of the casing string; and, washing any residual cement from the interior of the casing string before it hardens to avoid the necessity of drilling the cement therefrom at a subsequent time.

11. Method of cementing a casing in a borehole comprising:

(1) connecting an upper casing string to a lower casing string with a coupling member while running the casing string into the borehole, thereby forming a borehole annulus between the casing string and borehole;

(2) placing scratchers on said upper casing string;

(3) forming an isolated flow path which extends through the entire casing string to the bottom of the borehole;

(4) flowing cement along said isolated flow path and back up a lower part of the borehole annulus to cement the lower casing string within the lower part of the borehole;

(5) rotating the upper casing string relative to the lower casing string to unlatch the upper string from the lower string;

(6) reciprocatingly and rotatably moving the upper casing string uphole away from the lower casing string, using the relative movement of the upper string away from the lower string to form a lateral flow path which extends through the upper casing string and directly from the coupling member into the borehole annulus and using the relative rotary movement to clean an upper marginal wall surface of the borehole;

(7) flowing cement through the upper casing string down to the lateral flow path and directly into the borehole annulus at a location above the lower casing string, and forcing cement to flow up the borehole annulus towards the surface of the ground;

(8) reciprocatingly moving the upper casing string downhole towards the lower casing string and using the relative movement effected between the upper and lower casing strings to close the lateral flow path and to form a sealed flow passageway through the coupling member; and, (9) leaving the coupling member downhole as a permanent part of the casing string.

12. The method of claim 11, and further including the step of placing a plug device behind the flowing cement of step (3) and using a fluid to force the plug and cement towards the bottom of the casing so that drilling of cement from the interior of the casing is avoided.

13. The method of claim 12, and further including the step of placing a plug device behind the flowing cement and using a fluid to force the plug and cement towards the bottom of the casing so that drilling of cement from the interior of the casing is avoided; and, making said coupling member into a lost motion coupling which enables the upper casing string to be reciprocated as well as rotated respective to the lower casing string.

14. A cement staging tool for series connection into a string of casing comprising a lower sub, a barrel, an upper bushing, a mandrel; all concentrically aligned respective to one another and having an axial bore formed therethrough;

a seal assembly on said mandrel, a receptacle, means mounting said receptacle on said barrel for receiving said seal assembly in sealed relation therewith;

said mandrel being telescopingly received within said barrel; an annulus between said mandrel and barrel; stop means for limiting the upward telescoping movement of said mandrel;

means forming a pair of J-latch and guide assemblies on said barrel and mandrel by which said mandrel and barrel may be latched together when said seal assembly is seated in said receptacle;

said bushing being affixed to the upper end of said barrel, said lower sub being affixed to the lower end of said barrel;

a lateral port formed in a sidewall of said barrel at a location between said receptacle and said upper bushing;

so that said mandrel can be connected to an upper casing string while said lower sub is connected to a lower casing string and the string ran into a borehole;

said mandrel can be unlatched from said barrel and telescoped apart to open said lateral port to flow, and thereafter telescoped together to close the lateral flow path; while the upper and lower casing strings are always connected together by said tool, thereby enabling an upper string to be independently rotated and reciprocated respective to a lower string of casing.

15. A cement staging tool for series connection into a string of casing comprising a lower sub, a barrel, an upper bushing, a mandrel having a J formed thereon; all concentrically aligned respective to one another and having an axial bore formed therethrough; a seal assembly on said mandrel, a receptacle, means mounting said receptacle on said barrel for receiving said seal assembly in sealed relation therewith, said mandrel being telescopingly received within said barrel to form an annulus between said mandrel and barrel; stop means for limiting the upward telescoping movement of said mandrel; a guide on said barrel, said guide being positioned such that said mandrel can be telescoped into said barrel and turned to cause the guide to be engaged by the J and the barrel and mandrel thereby latched together when said seal assembly is seated in said receptacle, said bushing being affixed to the upper end of said barrel, said lower sub being affixed to the lower end of said barrel; said barrel having a lateral port formed in a sidewall thereof at a location between said receptacle and said upper bushing so that said mandrel can be connected to an upper casing string while said lower sub is connected to a lower casing string and the string run into a borehole; said mandrel can be unlatched from said barrel and telescoped apart to open said lateral port to flow, and thereafter telescoped together to close the lateral flow path; while the upper and lower casing strings are always connected together by said tool, thereby enabling an upper string to be independently rotated and reciprocated respective to a lower string of casing.

16. A cement staging tool for series connection into a string of casing comprising a lower sub, a barrel, an upper bushing, a mandrel; all concentrically aligned respective to one another and having an axial bore formed therethrough; a seal assembly on said mandrel, a receptacle, means mounting said receptacle on said barrel for receiving said seal assembly in sealed relation therewith; said mandrel being telescopingly received within said barrel; an annulus between said mandrel and barrel; stop means for limiting the upward telescoping movement of said mandrel; a J and guide, said J being formed on said mandrel with the guide being formed on said barrel; said mandrel can be telescoped further into said barrel and turned to cause the guide to be engaged by the J and the barrel and mandrel latched together when said seal assembly is seated in said receptacle, said J being positioned on said mandrel above said seal to abuttingly engage said upper bushing to form said stop means; said bushing being affixed to the upper end of said barrel, said lower sub being affixed to the lower end of said barrel; a lateral port formed in a sidewall of said barrel at a location between said receptacle and said upper bushing; so that said mandrel can be connected to an upper casing string while said lower sub is connected to a lower casing string and the string ran into a borehole; said mandrel can be unlatched from said barrel and telescoped apart to open said lateral port to flow, and thereafter telescoped together to close the lateral flow path; while the upper and lower casing strings are always connected together by said tool, thereby enabling an upper string to be independently rotated and reciprocated respective to a lower string of casing.

17. A cement staging tool for series connection into a string of casing comprising a lower sub, a barrel, an upper bushing a mandrel; all concentrically aligned respective to one another and having an axial bore formed therethrough; a seal assembly on said mandrel, a receptacle, means mounting said receptacle on said barrel for receiving said seal assembly in sealed relation therewith; said mandrel being telescopingly received within said barrel; an annulus between said mandrel and barrel; stop means for limiting the upward telescoping movement of said mandrel; a guide affixed to said barrel; a J member affixed to said mandrel and arranged such that the J member engages the guide in latched relation therewith when the seal is received within said seat; there being two guides spaced 180° apart and two J's spaced 180° apart with the guides being spaced apart sufficiently to permit the seal member to pass therebetween when the mandrel and barrel are telescoped apart; said stop being the upper end of said J and the lower end of said upper bushing which abuttingly engage one another when the mandrel and barrel are telescoped apart; said bushing being affixed to the upper end of said barrel, said lower sub being affixed to the lower end of said barrel; a lateral port formed in a sidewall of said barrel at a location between said receptacle and said upper bushing; so that said mandrel can be connected to an upper casing string while said lower sub is connected to a lower casing string and the string ran into a borehole; said mandrel can be unlatched from said barrel and telescoped apart to open said lateral port to flow, and thereafter telescoped together to close the lateral flow path; while the upper and lower casing strings are always connected together by said tool, thereby enabling an upper string to be independently rotated and reciprocated respective to a lower string of casing.

18. A cement staging tool for series connection into a casing string, comprising: a mandrel having an axial bore formed therein; a barrel having an axial bore formed therein to telescopingly receive said mandrel, a lateral port being formed in a side wall of said barrel; stop means for limiting telescoping movement of said mandrel axially away from said barrel; a seal assembly connected to said mandrel to close flow through the lateral port when said mandrel and barrel are telescoped together while opening flow through the lateral port when said mandrel and barrel are telescoped apart; and means including a J shape formed on said mandrel and a guide formed on said barrel such that said mandrel can be telescoped into said barrel and turned to cause the guide to be engaged by the J shape to thereby latch the barrel and mandrel together while permitting said mandrel to be independently rotated and reciprocated respective to said barrel when unlatched.

19. The tool of claim 18, wherein said latching means includes two guides being spaced 180 degrees apart and two J shapes spaced 180 degrees apart.

* * * * *